United States Patent [19]

Birdsall

[11] 4,132,412

[45] Jan. 2, 1979

[54] GAME BOARD WITH PIVOTAL PLANAR MEMBER

[76] Inventor: John D. Birdsall, 1262 Sunset Plaza Dr., Los Angeles, Calif. 90069

[21] Appl. No.: 726,974

[22] Filed: Sep. 27, 1976

[51] Int. Cl.[2] ..... A63F 3/04

[52] U.S. Cl. ..... 273/251; 273/284

[58] Field of Search ..... 273/134 D, 134 G, 134 C, 273/134 AA, 134 GA, 136 H, 136 GB, 136 R, 136 F, 105.2; 40/67, 107; 46/36, 37

[56] References Cited

U.S. PATENT DOCUMENTS

| | | | |
|---|---|---|---|
| 692,686 | 2/1902 | Lydick | 46/36 |
| 1,239,033 | 9/1917 | Norwood | 46/36 |
| 1,488,647 | 4/1924 | Quinn | 273/105.2 |
| 1,736,244 | 11/1929 | Baker | 273/105.2 |
| 2,211,297 | 8/1940 | Bull | 273/252 |
| 2,728,167 | 12/1955 | Knott | 46/37 |
| 3,279,109 | 10/1966 | Whittum | 40/67 |
| 3,782,728 | 1/1974 | Yasuda | 273/105.2 |

FOREIGN PATENT DOCUMENTS

| | | | |
|---|---|---|---|
| 562262 | 6/1944 | United Kingdom | 273/134 GA |

*Primary Examiner*—Robert W. Michell
*Assistant Examiner*—Arthur S. Rose
*Attorney, Agent, or Firm*—Keith D. Beecher

[57] ABSTRACT

A game is provided which includes a game board having a first planar member representative of the sea, with the upper edge of the first planar member representing the horizon. A second planar member, representing a ship, is pivotally mounted to the first planar member in essentially co-planar relationship therewith, so that as the second planar member is turned about its pivot axis, the ship represented thereby moves behind the first planar member and thereby sinks below the surface of the sea. The second planar member also has a rescue ship inscribed thereon, so that when the second planar member is fully turned through 180°, so as to position the first ship behind the first planar member, the rescue ship is revealed on the horizon. The game board also includes a third planar member adjacent the upper edge thereof and in essentially co-planar relationship therewith, and which is clipped to the first planar member. The third planar member represents the sky. The second planar member is mounted to be disposed between the first and third planar members.

11 Claims, 11 Drawing Figures

GAME BOARD WITH PIVOTAL PLANAR MEMBER

BACKGROUND OF THE INVENTION

The game of the invention is intended to represent the sinking of the Titanic. The game pieces each represent a ship's officer on board the Titanic. The object of the game is for each officer to collect food and water tokens, and to rescue passengers and take them to the lifeboats as the ship is sinking. The officer then boards one of the lifeboats with as many passengers, and with as many food and water tokens, as he was able to collect, as he made his way to the lifeboat. The lifeboat is then launched, and it moves about in the sea visiting islands, and has an objective of ultimately reaching the rescue ship. The first player to reach the rescue ship with at least two passengers, and two food and water tokens, wins the game, in accordance with presently promulgated rules.

DETAILED DESCRIPTION OF THE ILLUSTRATED EMBODIMENT

Figure 1:
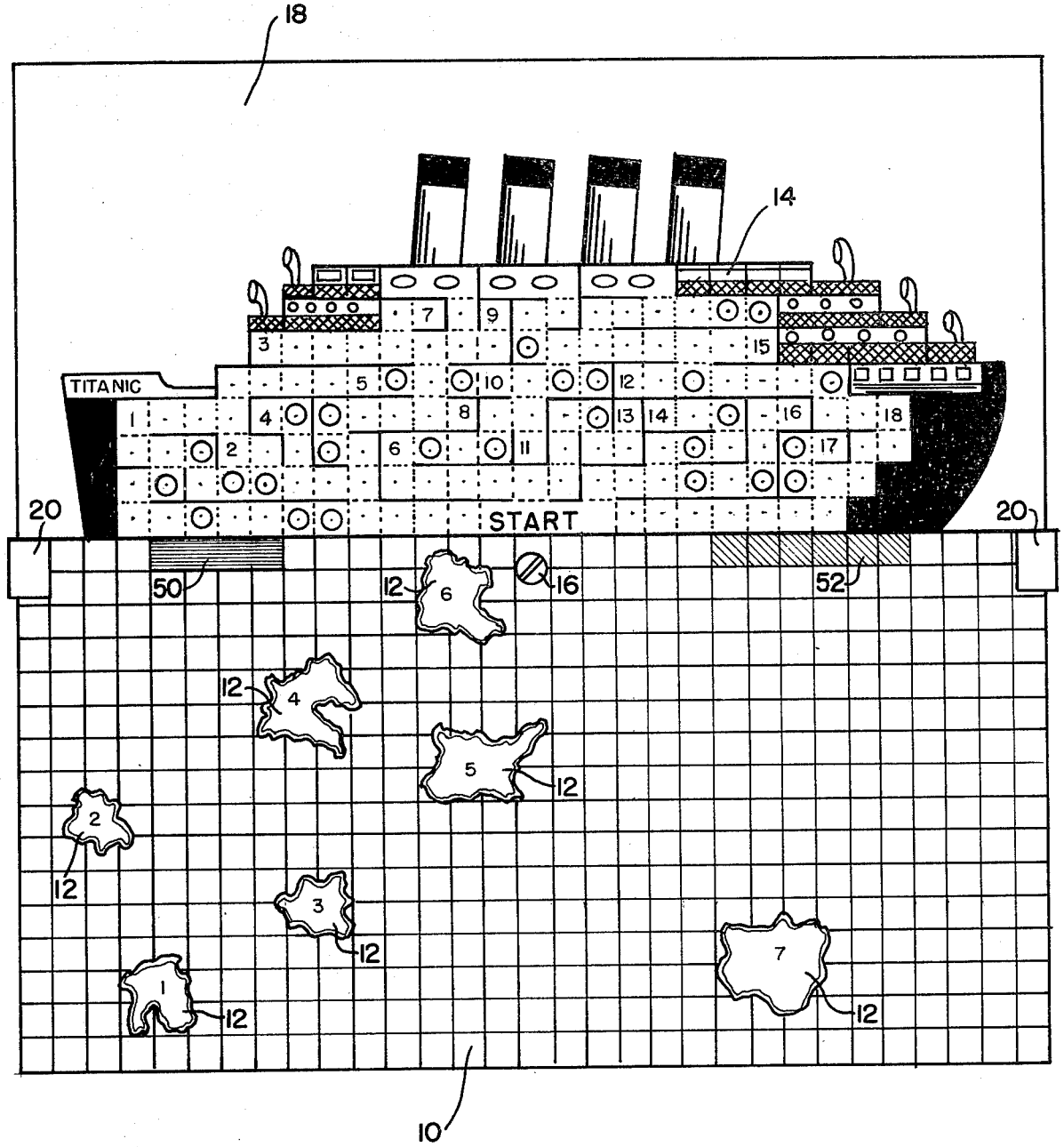
FIG. 1 is a top plan view of the game board of the invention, with the pivotally mounted planar member representing the Titanic in a position in which the Titanic has not yet started to sink.
Figure 2:
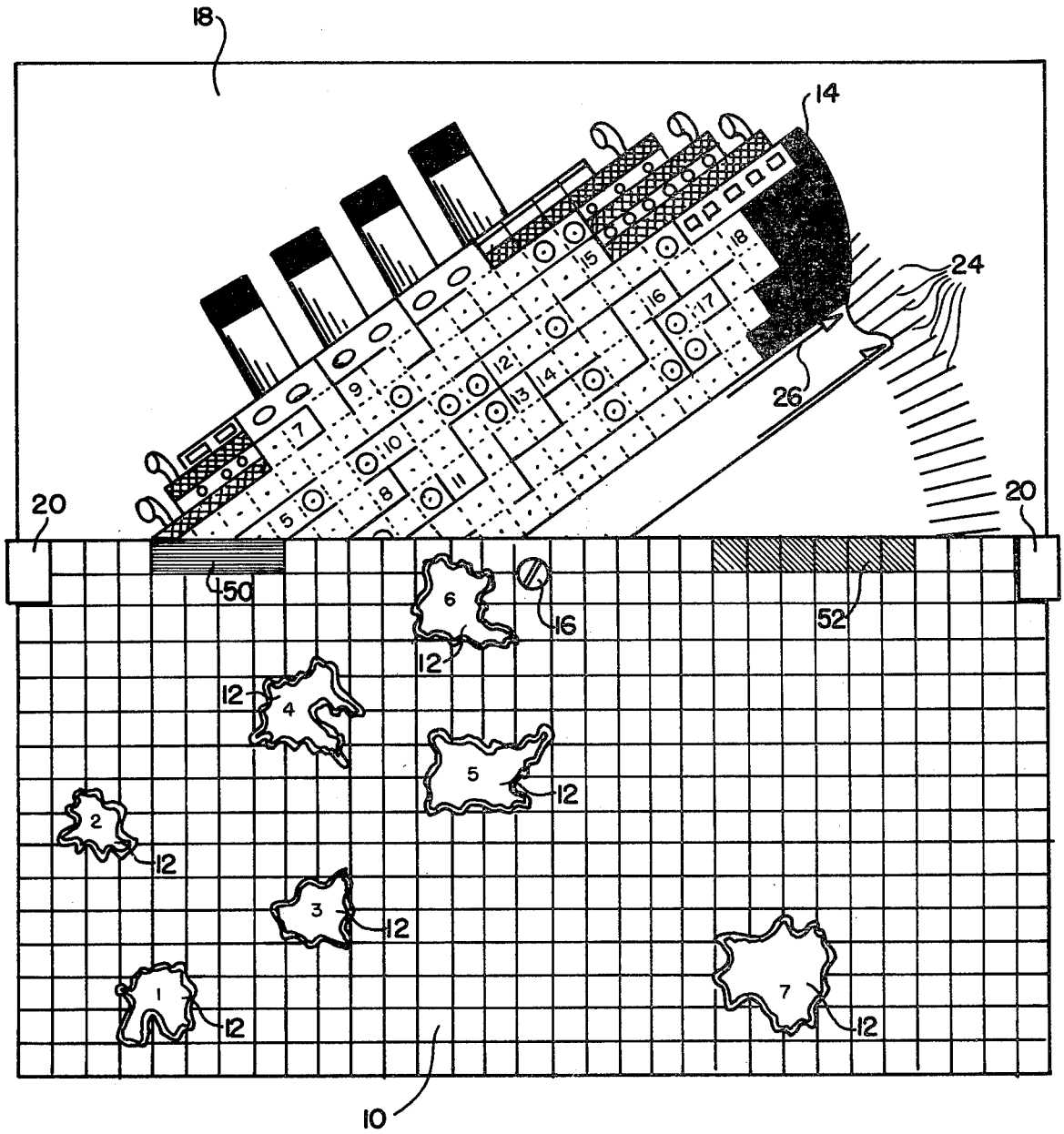
FIG. 2 is a top plan view of the game board of FIG. 1, in which the Titanic has started to sink below the level of the sea.
Figure 3:
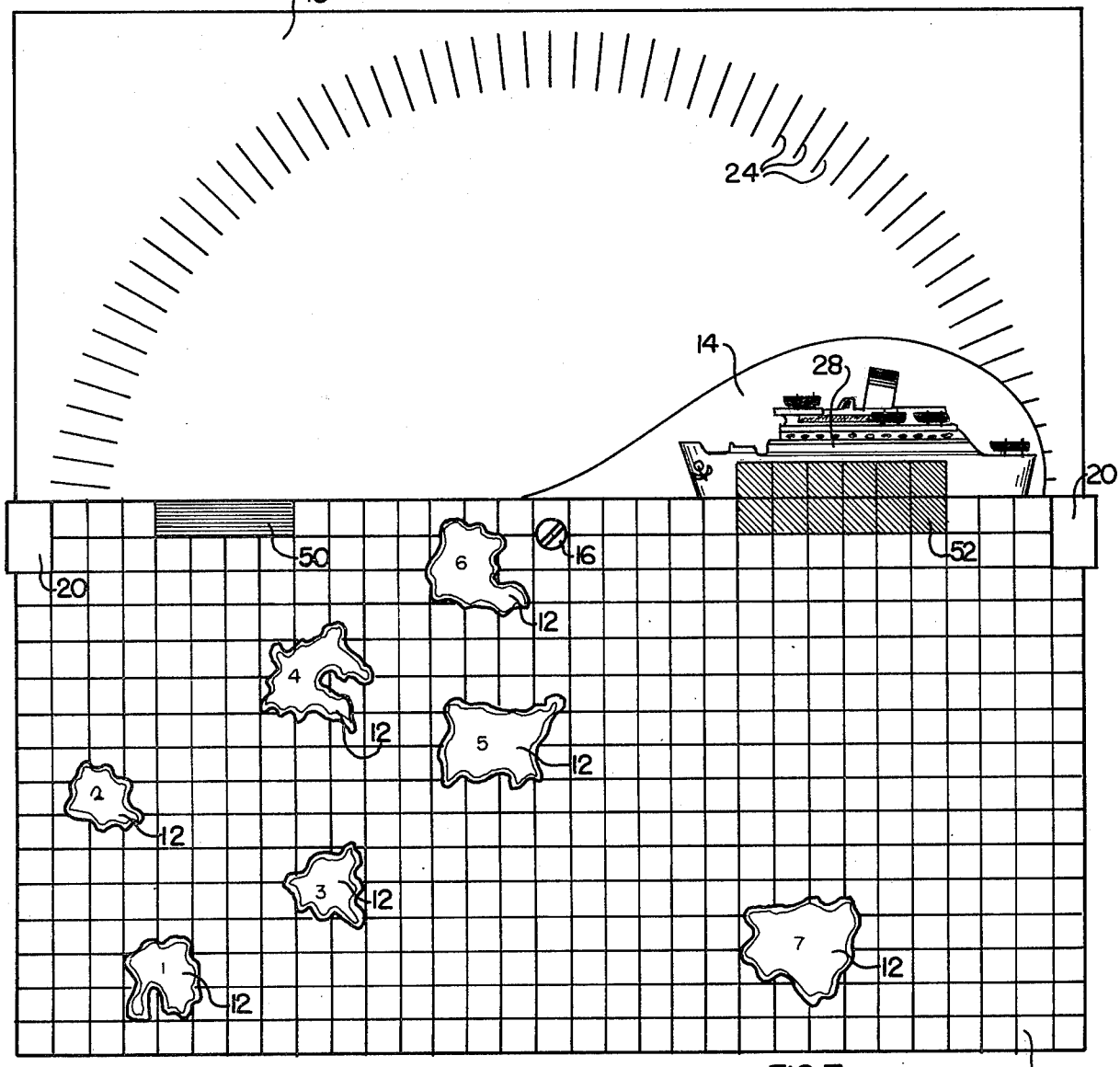
FIG. 3 is a representation of the game board, in which the Titanic has sunk completely below the level of the sea, and a rescue ship has appeared on the horizon.

As shown in FIGS. 1–3, the game includes a first planar member 10 which has inscriptions thereon representative of the sea, including a number of islands designated 12. A second planar member 14 in the form of a ship, is pivotally mounted to the first planar member 10 by means of a metal binder screw 16, or the like. The member 14 moves behind the planar member 10, as it is turned about its pivotal axis.

A third planar member 18 is attached to the first planar member 10 adjacent its upper edge by the binder screw 16, and by a pair of plastic retainer clips 20. The retainer clips hold the first and third planar members 10 and 18 in a spaced relationship, so that the planar member 14 may be turned to move the ship represented thereby between the planar members 10 and 18, behind the planar member 10, and in front of the planar member 18.

The planar member 18 has indicia thereon representing the sky. Planar member 18 also has inscriptions 24 (FIGS. 2 and 3) thereon which are hidden by the ship when in its position of FIG. 1, and which serve as indicia for an arrow 26 on planar member 14, so that the planar member 14 can be turned from one angular position to the next through a predetermined number of degrees, as the game is played. As the planar member 14 is so turned, the ship represented thereby sinks behind the planar member 10, as shown in FIG. 2, and completely disappears from view when the planar member is turned through 180°, as shown in FIG. 3.

As the planar member 14 is turned through 180°, a rescue ship 28 (FIG. 3), which is inscribed thereon appears above the horizon represented by the top edge of planar member 10.

Figure 4:
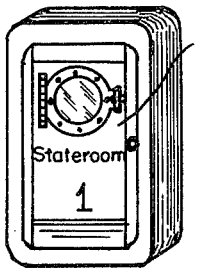
FIG. 4 is a representation of a stack of "Passenger" card which are used in playing the game.
Figure 5:
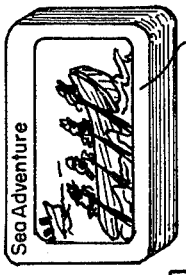
FIG. 5 is a representation of a stack of "Sea Adventure" cards which also are used in playing the game.
Figure 6:
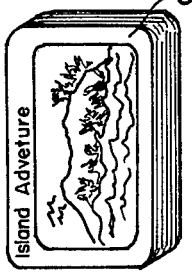
FIG. 6 is a representation of a stack of "Island Adventure" cards which, likewise, are used in playing the game.
Figure 7:
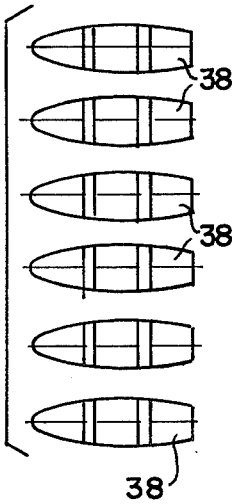
FIG. 7 shows a plurality of lifeboat tokens used in the game.
Figure 8:
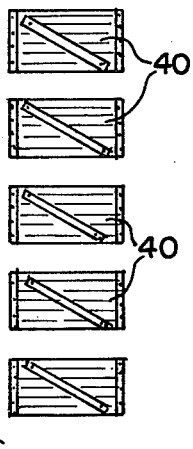
FIG. 8 shows a plurality of food tokens.
Figure 11:
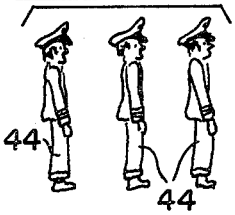
FIG. 11 shows a plurality of ship's officer game pieces which are used in playing the game.
Figure 9:
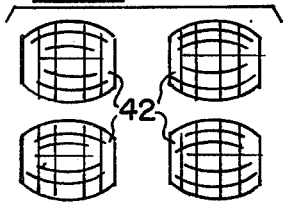
FIG. 9 shows a plurality of water tokens.

A stack of "Passenger" cards 32 (FIG. 4), a stack of "Sea Adventure" cards 34 (FIG. 5), and a stack of "Island Adventure" cards 36 (FIG. 6), are used in playing the game. Also, lifeboat tokens 38 (FIG. 7), food tokens 40 (FIG. 8) and water tokens 42 (FIG. 9) are also used in playing the game. The game pieces 44 (FIG. 11) are in the form of ship's officers, and each has a distinct color.

The "Passenger" cards 32 (FIG. 4) are shuffled, and each player is dealt one passenger card. Each passenger card has a representation of a stateroom and a number on one side. The remaining deck of passenger cards 32 are placed, with the stateroom facing up, near the game board. Each "Passenger" 32 bears a different stateroom number; each "Sea Adventure" cards 34 contain directions, such as "passenger in life jacket spotted . . . take one passenger", or "cask of water found floating in sea . . . take on water token", or "caught low flying seaqull . . . take on food token". The "Island Adventure" cards 36 (FIG. 6) also includes directions such as "attacked by hungry baboons — lose one food token", "cannibals having a beach party — lose one passenger", "monsoon hits island—lose one food and one water token".

Figure 10:
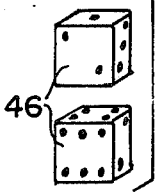
FIG. 10 shows a pair of dice.

Each player, in turn, rolls both dice 46 (FIG. 10), and each may move his game piece 44 any number of spaces, up to the total showing on the dice. The game pieces are moved along passageways (spaces with small dots on planar member 14) while attempting to reach staterooms (numbered spaces), water spaces (green dots) and food spaces (blue dots). The "start" space counts as one space, if moved through after the first turn.

The ship represented by planar member 14 initially has the position shown in FIG. 1. The ship is caused to sink a first angular increment after each player has taken his turn. Then, the ship sinks an additional angular increment for each number 1 or number 6 rolled on the dice. The ship is sunk from one angular increment to the next by turning member 14 counterclockwise about screw 16 (FIG. 2) to advance the arrow 26 from one indicia 24 to another.

The number on each "Passenger" card indicates the stateroom of the passenger that the player is assigned to rescue. The player, upon reaching his assigned stateroom, rescues the passenger and turns that card passenger side up. The card now belongs to him. The player then draws the top card from the deck of "Passenger" cards 32 (FIG. 4) for his new assignment. The player proceeds to his newly assigned stateroom beginning on his next turn. If the newly assigned stateroom is under the waterline, the card is returned to the bottom of the deck, and the player draws another card. Should an assigned stateroom sink under the waterline before the player gets to it, he returns his passenger card to the bottom of the deck, and draws a new card.

A player who ends his turn on a space with a blue spot collects one water token. At any time he ends his turn on a space with a green spot, he collects one food token. A player may accumulate any amount of passenger cards, food and water tokens, as he is able.

When desired, a player may abandon his current stateroom assignment and proceed by the roll of the dice to a lifeboat. The Passenger card for the abandoned assignment is returned to the bottom of the deck. When a game piece 44 reaches a lifeboat 38, the game piece is physically inserted into the lifeboat. Only one game piece at a time may occupy a lifeboat.

Lifeboats are launched one at a time as the ship sinks and lifeboat touches the edge of the lifeboat launching area 50. Occupied lifeboats are placed in the lifeboat launching area where they remain until the player takes his next turn. Any number of occupied lifeboats may be in the launching area at any given time. When a empty lifeboat is launched, it is immediately placed on island No. 1. The second empty lifeboat is placed on island No. 2, and so on.

A player is forced to move his playing piece directly to the lifeboat launching area as soon as either the last lifeboat is launched before he reaches it, or, the ship sinks past the center dot on the space he occupies. A player forced to move to the lifeboat launching area without a lifeboat loses his passengers, and food and water tokens. The Passenger cards are returned to the bottom of the deck, and the food and water tokens are returned to their respective piles adjacent to the game board.

While in the sea, a player in a lifeboat still has a chance to gain passengers, food and water. A player without a lifeboat must "swim" to an island and claim an empty lifeboat. Once a player has fulfilled the object of the game, he can move into the rescue ship and win the game.

A player who leaves the lifeboat launching area without a lifeboat is considered to be "swimming". He rolls only one dice and moves vertically or horizontally, but never diagonally. He moves his playing piece towards an island with a lifeboat. When he reaches an island with a lifeboat, he snaps his game piece inside the lifeboat. If two or more players move towards the same island, the empty lifeboat belongs to the first player who reaches the island, and the other players must go to other islands.

A player in a lifeboat on his turn rolls both dice. He uses the number on one dice to move vertically in either direction on the planar member 10, and the number on the other dice to move horizontally in either direction.

While in a lifeboat in the sea, a player draws a Sea Adventure card every time he rolls a number 1 on the dice. Two cards are drawn if he rolls number 1 on both dice. A player may on his turn chose to draw a Sea Adventure card instead of rolling the dice. Directions on the cards are then followed. A player who arrives on an island in a lifeboat draws an Island Adventure card when he lands. Directions on the card must be followed.

When the ship represented by the planar member 14 is almost sunk, the arrow 26 will disappear, and the rescue ship 28 (FIG. 3) will appear on the horizon. A player boards the rescue ship from the spaces designated 52. He cannot board the rescue ship until the rescue ship is completely above the water line, and only if the player has the required two passengers, and two food and water tokens.

It is to be understood, of course, that the foregoing instructions for playing the game are merely by way of example, and are not intended to limit the various ways in which the game may be played in any manner.

It is also apparent that although a particular embodiment of the game has been shown and described, modifications may be made. It is intended to cover all modifications which come within the scope of the invention in the following claims.

What is claimed is:

1. A game including a game board, said game board comprising a first planar member having inscriptions thereon representing the sea, a second planar member pivotally mounted to the first planar member and having a representation of a first ship thereon, so that when the second planar member is turned about its pivotal axis the ship represented thereon moves behind the first planar member so as to sink below the sea represented on said first planar member, and a third planar member positioned adjacent the top edge of said first planar member in displaced parallel relationship therewith, said third planar member representing the sky, said second planar member being interposed between said first planar member and said third planar member, said first planar member having a plurality of playing spaces, differentiated game pieces of a size to fit in said playing spaces, and chance means for governing the movement of said pieces.

2. The game defined in claim 1, in which said pivotal axis is perpendicular to said first planar member, and said second planar member also has a rescue ship inscribed thereon which is revealed above the surface of the sea represented by the first planar member when the second planar member is turned to a position in which the representation of the first ship thereon is behind the first planar member.

3. The game defined in claim 1, in which said first planar member also has inscriptions thereon representative of islands.

4. The game defined in claim 1, and which includes a pair of retainer clips positioned at the respective ends of the junction between the first and third planar members to hold the first and third planar members together in a spaced relationship on either side of the second planar member.

5. The game defined in claim 1, and which includes a plurality of Passenger cards for playing the game.

6. The game defined in claim 1, and which includes food and water tokens for playing the game.

7. The game defined in claim 1, and which includes a plurality of Sea Adventure cards for playing the game.

8. The game defined in claim 1, and which includes a plurality of Island Adventure cards for playing the game.

9. The game defined in claim 1, and which defines differently colored game pieces, each representative of a ship's officer, for playing the game.

10. The game defined in claim 1, and which includes a plurality of lifeboat tokens for playing the game.

11. The game defined in claim 1, in which said third planar member has inscriptions thereon serving as indicia as to the angular position of the second planar member as it is turned about its pivotal axis.

* * * * *